US005116807A

United States Patent [19]

Romanofsky et al.

[11] Patent Number: 5,116,807

[45] Date of Patent: May 26, 1992

[54] MONOLITHIC MM-WAVE PHASE SHIFTER USING OPTICALLY ACTIVATED SUPERCONDUCTING SWITCHES

[75] Inventors: Robert R. Romanofsky, Graton; Kul B. Bhasin, Rocky River, both of Ohio

[73] Assignee: The United States of America as represented by the Administrator of the National Aeronautics and Space Administration, Washington, D.C.

[21] Appl. No.: 587,921

[22] Filed: Sep. 25, 1990

[51] Int. Cl.[5] ..... H01P 1/18; H01P 3/08; H01B 12/00

[52] U.S. Cl. ..... 505/1; 505/703; 505/848; 505/866; 333/161; 333/995

[58] Field of Search ..... 333/161, 156, 164, 138, 333/103, 104, 995; 505/700-703-856, 862, 860, 866, 848, 849

[56] References Cited

U.S. PATENT DOCUMENTS

| | | | |
|---|---|---|---|
| 2,916,615 | 12/1959 | Lundburg | 333/995 |
| 3,202,836 | 8/1965 | Nyberg | 307/476 |
| 3,917,943 | 11/1975 | Auston | 250/211 J |
| 4,074,343 | 2/1978 | Chaussy et al. | 363/14 |
| 4,305,052 | 12/1981 | Baril et al. | 333/161 X |
| 4,370,568 | 1/1983 | Lumley | 307/260 |
| 4,396,833 | 8/1983 | Pan | 250/211 J |
| 4,441,088 | 4/1984 | Anderson | 333/1 |
| 4,499,441 | 2/1985 | Lynch et al. | 333/161 |
| 4,586,062 | 4/1986 | Bouffard et al. | 357/5 |
| 4,616,196 | 10/1986 | Sharma | 333/161 |
| 4,675,624 | 6/1987 | Rosen et al. | 333/161 |
| 4,837,536 | 6/1989 | Honjo | 333/247 |
| 4,876,239 | 10/1989 | Cachier | 505/1 |
| 4,990,487 | 2/1991 | Masumi | 505/703 X |

FOREIGN PATENT DOCUMENTS

| | | | |
|---|---|---|---|
| 3529560 | 2/1987 | Fed. Rep. of Germany | 333/161 |
| 1406667 | 6/1988 | U.S.S.R. | 333/161 |

OTHER PUBLICATIONS

Donadlson et al., "Interaction of Picosecond Optical Pulses with High Tc Superconducting Films", Appl. Phys. Lett. 54(24), Jun. 12, 1989, pp. 2470-72.

*Primary Examiner*—Eugene R. LaRoche
*Assistant Examiner*—Seung Ham
*Attorney, Agent, or Firm*—James A. Mackin; Gene E. Shook; John R. Manning

[57] ABSTRACT

A phase shifter having a reference path and a delay path, light sources, and superconductive switches. Each of the superconductive switches is terminated in a virtual short circuit, which may be a radial stub. Switching between the reference path and delayed path is accomplished by illuminating the superconductive switches connected to the desired path, while not illuminating the superconductive switches connected to the other path.

9 Claims, 2 Drawing Sheets

MONOLITHIC MM-WAVE PHASE SHIFTER USING OPTICALLY ACTIVATED SUPERCONDUCTING SWITCHES

ORIGIN OF THE INVENTION

The invention described herein was made by employees of the U.S. Government and may be manufactured and used by or for the Government for governmental purposes without the payment of any royalties thereon or therefor.

BACKGROUND OF THE INVENTION

1. Field of the Invention

The present invention relates generally to millimeter-wave phase shifters, and more particularly to monolithic millimeter-wave phase shifters using optically activated superconducting switches.

2. Description of the Related Art

Phased-array antennas are increasingly being used in radar systems, e.g. mm-wave radar systems, and in communications systems, e.g. satellite communication systems. These antennas permit electronic beam steering, obviating the need for mechanical pointing. In order to utilize a phased-array antenna, these system must include a phase shifter, which provides incremental offset phase excitation to each element in the array.

Though many types of phase shifters exist, the most desirable is the true time delay type, which can provide frequency independent steering for large arrays. The most popular true time delay phase shifter utilizes a switched line technique. This technique achieves true time delay by switching an input signal between two alternative routes, i.e., a reference path and a delay path. The delay path has a transmission length that is longer than that of the reference path by a portion of the wavelength of the input signal, and therefore causes the signal transmitted therethrough to exit out-of-phase relative to the signal transmitted through the reference path. Field effect transistor (FET) switches or diode switches have been utilized to switch the signal between the reference path and the delay path. Four of these switches are required per bit.

These conventional phase shifters include the following disadvantages: asymmetric insertion loss between the delay path and the reference path, high overall insertion loss, poor isolation between the radio frequency signal and switch bias signals, and signal distribution complexity. The difference in insertion loss between the delay path and the reference path results primarily from variation in the shunt capacitance of the switches during their on and off states. Some investigators have attempted to resonate out the shunt capacitance of the switches during their off state using parallel inductors. This approach has met with only limited success and is difficult to achieve at millimeter wavelengths. The lack of insertion loss symmetry degrades system performance and requires complex and expensive compensation devices. Generally, asymmetric insertion loss due to the different transmission lengths of the reference path and the delay path is minimal in comparison to that caused by variation in the shunt capacitance of the switches.

The total insertion loss of conventional phase shifters is large and is roughly proportional to the reactance associated with the switches, e.g., typically greater than 2 dB per bit at 30 GHz. Also, interaction between the radio frequency signal and the switch bias signals required to control the switches presents another problem. Standing-wave patterns are set-up on the biasing lines, resulting in unpredictable performance and sensitivity to bondwire lengths.

Also, because some of the systems in which conventional phase shifters are used may include hundreds of elements per array and perhaps five bits per element, and because each bit requires a minimum of two control lines to toggle the switches, signal distribution is complex.

SUMMARY OF THE INVENTION

It is an object of the present invention to provide an improved phase shifter that has low overall insertion loss and symmetric insertion loss between the reference path and the delay path.

Another object of the present invention is to provide an improved phase shifter that eliminates interactions between the radio frequency signal and the biasing networks of conventional phase shifters.

Still another object of the present invention is to provide an improved phase shifter having greatly reduced signal distribution complexity, reduced control logic problems and reduced system weight.

In order to achieve the foregoing and other objects, in accordance with the purposes of the present invention as described herein, a phase shifter having an input line with a bifurcation junction and an output line with a rejoining junction, comprises: a reference path and a delay path, each extending from the bifrication junction to the rejoining junction; illumination means for providing light; and switching means operatively connected to the reference path and delay paths for switching between the reference path and the delay path in response to the illumination means.

In the preferred embodiment of the present invention, the switching means includes four switches that are made from a superconductive material. These switches are each terminated in a virtual short circuit. Two of the switches are connected to the reference path, and the other two switches are connected to the delay path. Two of the switches are located about one quarter of a wavelength from the bifurcation junction, and the other two switches are located about one quarter of a wavelength from the rejoining junction. Each of the switches is normally held near its transition temperature, i.e., the temperature at which the switch enters a superconductive state from a resistive state, so that each switch is normally in a superconductive state. The switches on either the reference path or the delay path are selectively illuminated by the illumination means, and thereby enter a resistive state. Alternative embodiments suitable for causing a resistive state include but are not limited to: local application of a magnetic field above the critical field of the superconductor and application of a current through the switch above the critical current of the superconductor. The radio frequency signal entering through the input line is transmitted through the path which has its respective switches in the resistive state and reflected from the other path which has its respective switches in the superconductive state.

These and other features and advantages of the present invention will become more apparent with reference to the following detailed description and drawings.

BRIEF DESCRIPTION OF THE DRAWINGS

The accompanying drawings illustrate several aspects of the present invention, and together with the description serve to explain the principles of the present invention. In the drawings.

DETAILED DESCRIPTION OF THE PREFERRED EMBODIMENTS

Figure 1:
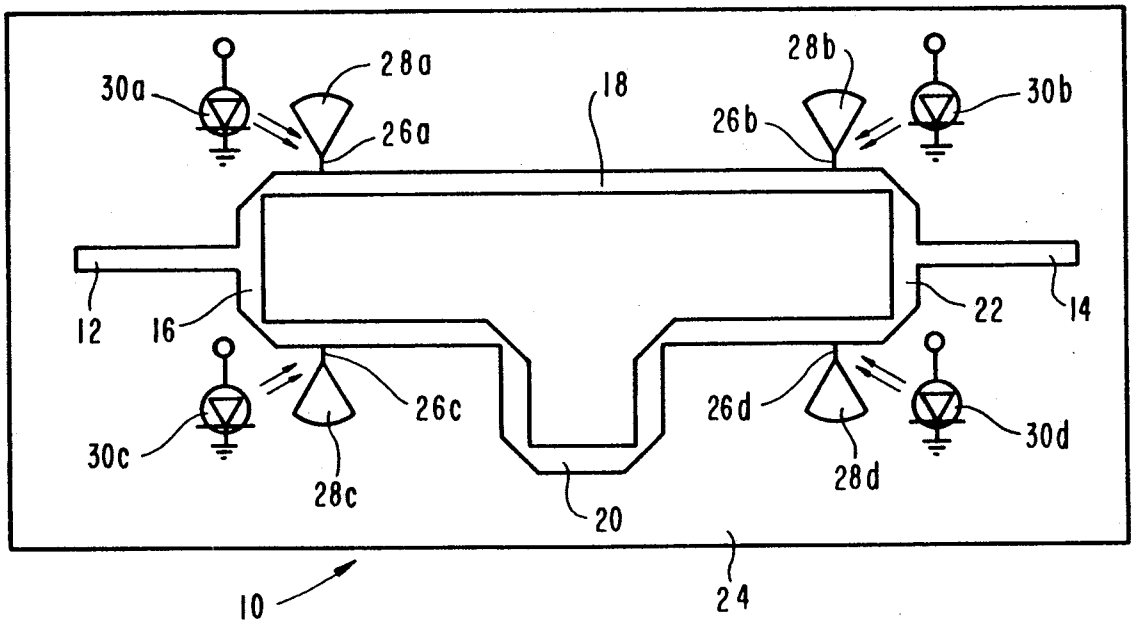
FIG. 1 is a top view of a phase shifter according to the present invention.

FIG. 1 shows a top view of a phase shifter 10 according to the present invention. Phase shifter 10 includes an input line 12 and an output line 14. Input line 12 has a bifurcation junction 16, from which a reference path 18 and a delay path 20 extend. Reference path 18 and delay path 20 meet with output line 14 at a rejoining junction 22. Input line 12, output line 14, reference path 18 and delay path 20 may be, for example, thin-film strips formed on a substrate 24 and are made from a conductive material, such as silver, or a superconductive material, such as Yttrium-Barium-Copper-Oxide (YBaCuO). Phase shifter 10 may be a microstrip circuit, i.e., wherein input line 12, output line 14, reference path 18 and delay path 20 are thin-film conductive strips formed on substrate 24, which is a dielectric material having a thin-film ground-plane conductor (not shown).

Delay path 20 has a greater length than reference path 18. More specifically, delay path 20 is longer than reference path 18 by a fraction or a multiple of a fraction of the wavelength of a signal entering through input line 12. Therefore, when the signal enters through input line 12 and travels along and exits delay path 20, it will be out-of-phase relative to a signal traveling along and exiting through reference path 18. For example, if the length difference between delay path 20 and reference path 18 is an odd-multiple of half-wavelengths of the signal, then the signal exiting delay path 20 will be 180° out-of-phase relative to the signal exiting reference path 18.

Phase shifter 10 also includes superconducting switches 26*a*, 26*b*, 26*c*, 26*d*, which may be fabricated from a high-temperature superconductor, e.g., Yttrium-Barium-Copper-Oxide (YBaCuO). Two superconducting switches 26*a*, 26*b* are electrically connected to reference path 18, and two additional superconductor switches 26*c*, 26*d*, are electrically connected to delay path 20. Each switch 26*a*, 26*b*, 26*c*, 26*d* is located about one quarter of a wavelength from either bifurcation junction 16 or rejoining junction 22. That is, two superconducting switches 26*a*, 26*c* are located one quarter of a wavelength from either bifurcation junction 16, while the other two superconducting switches 26*b*, 26*d* are located one quarter of a wavelength from rejoining junction 22.

Figure 2:
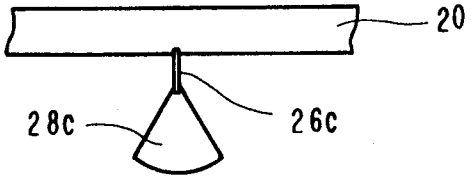
FIG. 2 is an enlarged top view of a portion of the phase shifter shown in FIG. 1.

Each of the respective superconducting switch 26*a*, 26*b*, 26*c*, 26*d* is terminated in a virtual short circuit using radial stubs 28*a*, 28*b*, 28*c*, 28*d*. Radial stubs 28*a*, 28*b*, 28*c*, 28*d*, however, could alternatively be any other type of resonator having high impedance, e.g., rectangular stubs or gap coupled radial stubs. Radial stubs are preferred because they have broader bandwidths. Gap coupled radial stubs may be coupled to superconducting switches 26*a*, 26*b*, 26*c*, 26*d* through a gap discontinuity having a length that is much less than a wavelength. Gap coupled radial stubs add additional bandwidth due to the transformer-like qualities of the gap discontinuity and may be used as tuning elements to tailor the characteristics of phase shifter 10. Radial stubs 28*a*, 28*b*, 28*c*, 28*d* may be formed on a substrate 24 and may be made of any good conductor, such as silver, or a superconductive material, such as YBaCuO. As best shown in FIG. 2, each of the superconducting switches 26*a*, 26*b*, 26*c*, 26*d* contacts a respective one of the radial stubs 28*a*, 28*b*, 28*c*, 28*d* and either reference path 18 or delay path 20.

Phase shifter 10 also includes light sources 30*a*, 30*b*, 30*c*, 30*d* each respectfully associated with one of the superconducting switches 26*a*, 26*b*, 26*c*, 26*d*. Light sources 30*a*, 30*b*, 30*c*, 30*d* may be formed on substrate 24 and may be LEDs as shown in FIG. 1. Alternatively, light sources 30*a*, 30*b*, 30*c*, 30*d* may be, for example, lasers, laser diodes, and/or optic fibers.

Phase shifter 10 may be monolithic, i.e., wherein input line 12, output line 14, reference path 18, delay path 20, superconducting switches 26*a*, 26*b*, 26*c*, 26*d*, radial stubs 28*a*, 28*b*, 28*c*, 28*d*, and light sources 30*a*, 30*b*, 30*c*, 30*d* are formed in or on substrate 24.

Superconducting switches 26*a*, 26*b*, 26*c*, 26*d* operate in the bolometric mode, i.e., superconducting switches 26*a*, 26*b*, 26*c*, 26*d* are normally held in a temperature region near their transition temperature, so that the superconductive switches 26*a*, 26*b*, 26*c*, 26*d* are normally in a superconductive state or a nearly superconductive state. In this temperature region, e.g., approximately 80° K. for YBaCuO, the temperature derivative of resistance (dR/dT) is maximum. Light emitted from light sources 30*a*, 30*b*, 30*c*, 30*d* raises the temperature of superconducting switches 26*a*, 26*b*, 26*c*, 26*d* and consequently causes superconducting switches 26*a*, 26*b*, 26*c*, 26*d* to enter a resistive state. Alternatively, light sources with energy greater than the superconductor band gap can be used to dissociate the superconducting electron pairs and cause the transition from a superconducting to a resistive state.

A signal entering input line 12 is directed to either reference path 18 or delay path 20 depending on the state of superconducting switches 26*a*, 26*b*, 26*c*, 26*d*. Reference path 18 and delay path 20 do not operate in a power splitting mode, and therefor each maintains the same characteristic impedance, for example, a fifty ohm characteristic. For example, if superconducting switches 26*a*, 26*b* associated with light sources 30*a*, 30*b* are illuminated, these superconducting switches 26*a*, 26*b* will enter a resistive state. In addition, superconducting switches 26*c*, 26*d* associated with the delay path 20 are not illuminated by their respective light sources 30*c*, 30*d* and are consequently in a superconductive state. Because superconducting switches 26*c*, 26*d* associated with delay path 20 are respectively positioned one quarter of a wavelength from the bifurcation junction 16 and the rejoining junction 22, the signal is reflected in-phase from delay path 20 to bifurcation junction 16 and rejoining junction 22. Therefore, when superconducting switches 26*a*, 26*b* associated with reference path 18 are illuminated by their corresponding light sources 30*a*, 30*b*, and superconducting switches 26*c*, 26*d* associated with in delay path 20 are not illuminated by their corresponding light sources 30*c*, 30*d*, the signal entering input line 12 will be transmitted only through reference path 18.

On the other hand, to achieve the desired phase shift, superconducting switches 26*c*, 26*d* associated with delay path 20 are illuminated by their corresponding light sources 30*c*, 30*d* while superconducting switches 26*a*, 26*b* associated with reference path 18 are not illuminated by their corresponding light sources 30*a*, 30*b*.

Preferably, superconducting switches 26*a*, 26*b*, 26*c*, 26*d* have an aspect ratio, i.e., the ratio of length over width, of about 25:1. For example, superconducting switches 26*a*, 26*b*, 26*c*, 26*d* may be about 0.005 inches long and about 0.0002 inches wide. The resistivity of superconducting switches 26*a*, 26*b*, 26*c*, 26*d* while illuminated by light sources 30*a*, 30*b*, 30*c*, 30*d* depends upon the thickness and the resistivity of the material from which they are made. For example, superconducting switches 26*a*, 26*b*, 26*c*, 26*d* having a thickness of about one micron produce a resistance of about 250 ohms to about 500 ohms when illuminated by light sources 30, 30*b*, 30*c*, 30*d*. The efficiency of superconducting switches 26*a*, 26*b*, 26*c*, 26*d* is inversely proportional to the product of their resistance in the superconducting state and their resistance in the resistive state. Theoretically, this efficiency would tend toward infinity if the surface resistance was vanishingly small. However, the superconductive state of the superconducting switches 26*a*, 26*b*, 26*c*, 26*d* need not be perfectly superconducting to guarantee a high degree of insertion loss symmetry.

Figure 3:
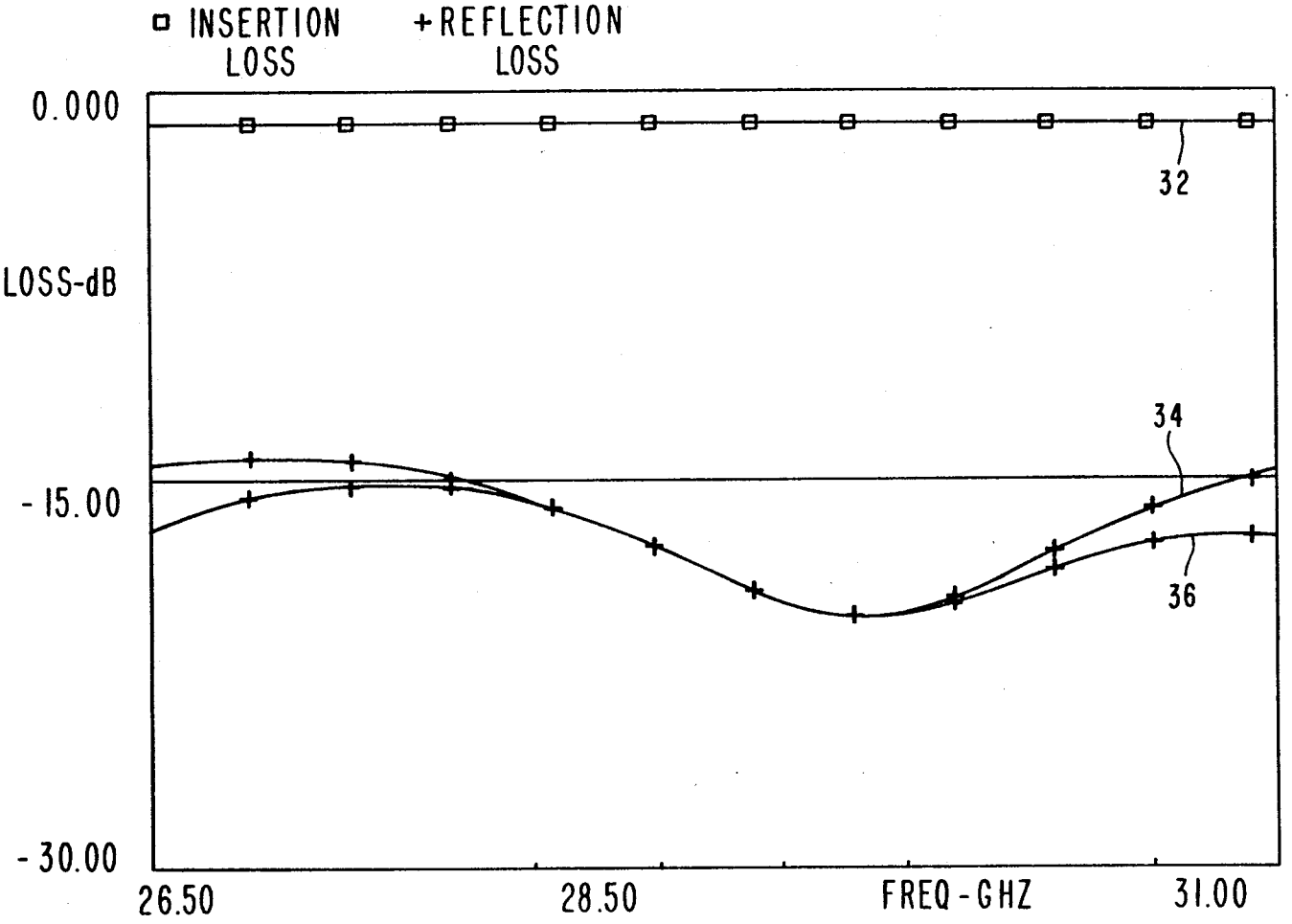
FIG. 3 is a graph that shows modeled predictions of loss values at various frequencies for a phase shifter according to the present invention.

FIG. 3 shows modeled predictions of insertion loss for a 180° phase shifter according to the present invention within a selected frequency range. This data required that the surface resistance of the superconductor be only as good as normal metal at 77° K. when in the superconducting state. Superconducting switches 26*a*, 26*b*, 26*c*, 26*d* were treated as distributed resistors to insure modeling accuracy. Linear curve 32 is a plot of insertion loss for both reference path 18 and delay path 20. Thus insertion loss between reference path 18 and delay path 20 is exceptionally symmetric. Also, overall insertion loss is low, i.e., less than 2 dB. In addition, a curve 34 shows reflection loss for reference path 18 and a curve 36 shows reflection loss for delayed path 20. Though not quite symmetric, return loss is excellent, and is generally less than 15 dB through a major portion of the modeled frequency range. Phase shifters according to the present invention overcome the symmetry limitations of conventional phase shifters. Therefore, system performance is enhanced in comparison to conventional phase shifters, and the need for complex compensation devices is negated. Also, phase shifters according to the present invention reduce total insertion loss, thereby increasing system efficiency.

Another advantage of phase shifters according to the present invention is signal isolation. More precisely, a phase shifter of the present invention eliminates interactions between radio frequency signals and the switch bias lines of conventional phase shifters. In the present invention there are no bias lines on which standing-wave patterns can be set up as in conventional phase shifters.

In addition, phase shifters according to the present invention inherently reduce signal distribution complexity, as well as overall system weight.

Numerous modifications and adaptations of the present invention will be apparent to those so skilled in the art. For example, light sources 30, 30*b*, 30*c*, 30*d* may include optic fibers to further reduce signal distribution complexity and overall system weight. In addition, a phase shifter according to the present invention may include more than one delay path. Also, radial stubs 28*a*, 28*b*, 28*c*, 28*d* may instead be rectangular stubs or gap coupled radial stubs. Thus, it is intended by the following claims to cover all modifications and the adaptations which fall within the true spirit and scope of the invention.

What is claimed is:

1. A monolithic phase shifter having an input and an output, comprising:

a substrate;

a bifurcation junction operatively connected to the input and forming a reference path and a delay path;

a rejoining junction operatively connected to the output and joining said reference and delay paths;

first and second light-activated, superconducting switches disposed in said reference and delay paths, respectively, each switch being about one quarter wavelength from the bifurcation junction;

third and fourth light-activated, superconducting switches disposed in said reference and delay paths, respectively, each switch being about one quarter wavelength away from the rejoining junction;

first illumination means for providing light to said first and third switches;

second illumination means for providing light to said second and fourth switches, said first and second illumination means providing light alternately, and wherein said bifurcation and rejoining junctions, said reference and delay paths, and said switches are formed on said substrate.

2. A phase shifter as recited in claim 15, further comprising:

stub means operatively connected to said superconducting switches for terminating said superconducting switches in a virtual short circuit.

3. A phase shifter as recited in claim 2, wherein:

said stub means includes a radial stub.

4. A phase shifter as recited in claim 1, wherein:

said superconductive material is Yttrium-Barium-Copper-Oxide.

5. A phase shifter as recited in claim 4, wherein:

said reference and delay paths include silver.

6. A phase shifter as recited in claim 1, wherein:

said illumination means includes at least one light emitting diode.

7. A phase shifter as recited in claim 1, wherein:

said superconducting switches each have an aspect ratio of about 25:1.

8. A phase shifter as recited in claim 7, wherein:

said superconducting switches each have a width of about 0.0002 inches and a length of about 0.005 inches.

9. A phase shifter as recited in claim 8, wherein:

said superconducting switches each have a thickness of about one micron.

* * * * *